US006669515B1

(12) United States Patent
Urban et al.

(10) Patent No.: US 6,669,515 B1
(45) Date of Patent: Dec. 30, 2003

(54) APPARATUS FOR SECURING CABLE

(75) Inventors: Blake R. Urban, Lenior, NC (US); Isaac D. M. White, Orlando, FL (US); James E. Dickens, Ocoee, FL (US); Kevin Forsberg, Orlando, FL (US); Charles Sawyer, Orlando, FL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/326,709

(22) Filed: Dec. 20, 2002

(51) Int. Cl.[7] ..... H01R 11/09

(52) U.S. Cl. ..... 439/797; 439/798; 439/181; 439/440; 439/810; 174/64; 174/65

(58) Field of Search ..... 439/797, 798, 439/810, 440, 460, 462, 181; 174/64, 65 R, 135

(56) References Cited

U.S. PATENT DOCUMENTS

| | | | | |
|---|---|---|---|---|
| RE23,720 | E | | 10/1953 | Gillespie |
| 2,828,147 | A | | 3/1958 | Peiffer |
| 4,000,875 | A | | 1/1977 | Jemison et al. |
| 4,209,661 | A | | 6/1980 | Pate et al. |
| 4,236,281 | A | | 12/1980 | Bottum |
| 4,262,409 | A | | 4/1981 | Madej |
| 4,424,627 | A | * | 1/1984 | Tarbox |
| 4,455,717 | A | | 6/1984 | Gray |
| 4,624,520 | A | * | 11/1986 | Blum |
| 4,724,279 | A | * | 2/1988 | Ayscue |
| 5,030,106 | A | * | 7/1991 | Cameron et al. |
| 5,195,219 | A | | 3/1993 | Hurtig |
| 5,276,280 | A | | 1/1994 | Ball |
| 5,374,017 | A | | 12/1994 | Martin |
| 5,718,610 | A | * | 2/1998 | Faber |
| 5,744,753 | A | * | 4/1998 | Nattel |
| 6,194,660 | B1 | | 2/2001 | Bradt |
| 6,457,988 | B1 | | 10/2002 | Anderson |

* cited by examiner

*Primary Examiner*—Anthony Dinkins
*Assistant Examiner*—Nguyen T. Ha
(74) *Attorney, Agent, or Firm*—Walters & Zimmerman

(57) ABSTRACT

An apparatus is disclosed for clamping cable. The apparatus is a barrier that clamps and/or adheres to the cable. The barrier has a base, and the base has a diameter greater than an aperture through which the cable passes. The base of the barrier hinders the cable from pulling through the aperture, yet the barrier allows the cable to push through the aperture.

12 Claims, 13 Drawing Sheets

APPARATUS FOR SECURING CABLE

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to cables, wires, and other electrical conductors and, more particularly, to terminal and junction boxes with apertures, openings, and strain relief couplings.

2. Description of the Related Art

"Aerial Service Wire" provides telephone service to a customer. Aerial service wire is telephone cable that spans from a utility pole to the customer's premises. Aerial service wire, however, may also run underground to the customer's premises. When aerial service wire spans from a utility pole to the customer's premises, the aerial service wire is clamped and hung from a terminal at the utility pole.

Aerial service wire, however, can be pulled out of the terminal. Aerial service wires are hung from the terminal using a three-piece clamp. This three-piece clamp is commonly called a "P-clamp." Once the P-clamp is assembled to the aerial service wire, the P-clamp is then hung from inside the terminal. One problem, however, is that the aerial service wire may pull out of the terminal. If the P-clamp fails, or if the P-clamp becomes unhooked from the terminal, tension in the aerial service wire pulls the aerial service wire out of the terminal. The aerial service wire may even rip from the terminal, thus impairing a customer's telecommunications service.

One solution has been to "bunny ear" the aerial service wire. After the aerial service wire is hung from within the terminal, some telecommunications service providers instruct the technician to knot the outer insulation of the aerial service wire. That is, the technician is instructed to slit the outer insulation of the aerial service wire. Once the outer insulation is slit, the technician then ties the outer insulation into a knot. The loops in the knot, or the "bunny ears," are snipped from the knot. The knot acts as an obstruction to help prevent the aerial service wire from pulling through an aperture in the terminal.

Knotting the outer insulation, however, is not a workable solution. First, the knotting requirement is a time-consuming procedure. Even though the technicians are instructed to knot the outer insulation, some technicians are pressed for time and skip the knotting procedure. Second, when the outer insulation is slit and knotted, the copper conductors within the aerial service wire are increasingly exposed to the ambient environment. Sometimes the copper conductors are themselves slit when cutting the outer insulation. This environmental exposure degrades the quality of the customer's communication service. There is, accordingly, a need in the art for an apparatus that allows a technician to quickly secure aerial service wires within terminals and other enclosures.

BRIEF SUMMARY OF THE INVENTION

The aforementioned problems, a nd other problems, are reduced by an apparatus for securing cable. This invention helps prevent aerial service wires, electrical conductors, fiber optic cables, and other cables from pulling out of terminals and enclosures. This invention, in particular, is a barrier that secures to the cable. This barrier secures to a portion of the cable routed within the terminal or the enclosure. The barrier has a larger diameter than an aperture through which the cable passes. Because the barrier has a larger diameter than the aperture, the barrier helps prevent the cable from pulling out of the terminal/enclosure. The barrier of this invention quickly and easily installs onto the cable, thus allowing the technician to quickly reduce tension in the cable. This invention also saves money by permitting the technician to complete more repairs per week.

One embodiment of this invention describes an apparatus for securing cable. This apparatus comprises a barrier adhered to the cable. The barrier has a base, and the base has a diameter greater than an aperture through which the cable passes. Because the base has a larger diameter than the aperture, the base of the barrier hinders, or even prevents, the barrier (and thus the adhered cable) from being pulled through the aperture. The barrier, however, allows the cable to push through the aperture.

Another embodiment of this invention describes an apparatus for securing cable. This embodiment comprises a barrier clamped to the cable. The barrier has an upper end, a lower end, and an interior passage extending from the upper end to the lower end. The interior passage has an inner wall defining a passage axis extending from the upper end to the lower end. The interior passage is open at the upper end and open at the lower end such that an end of the cable is inserted into the lower end, pushed through the interior passage, and pushed out the upper end. The barrier also has a base. The base has a diameter greater than an aperture through which the cable passes, so the base of the barrier hinders the cable from pulling through the aperture. The barrier, however, allows the cable to push through the aperture.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

Figure 1:
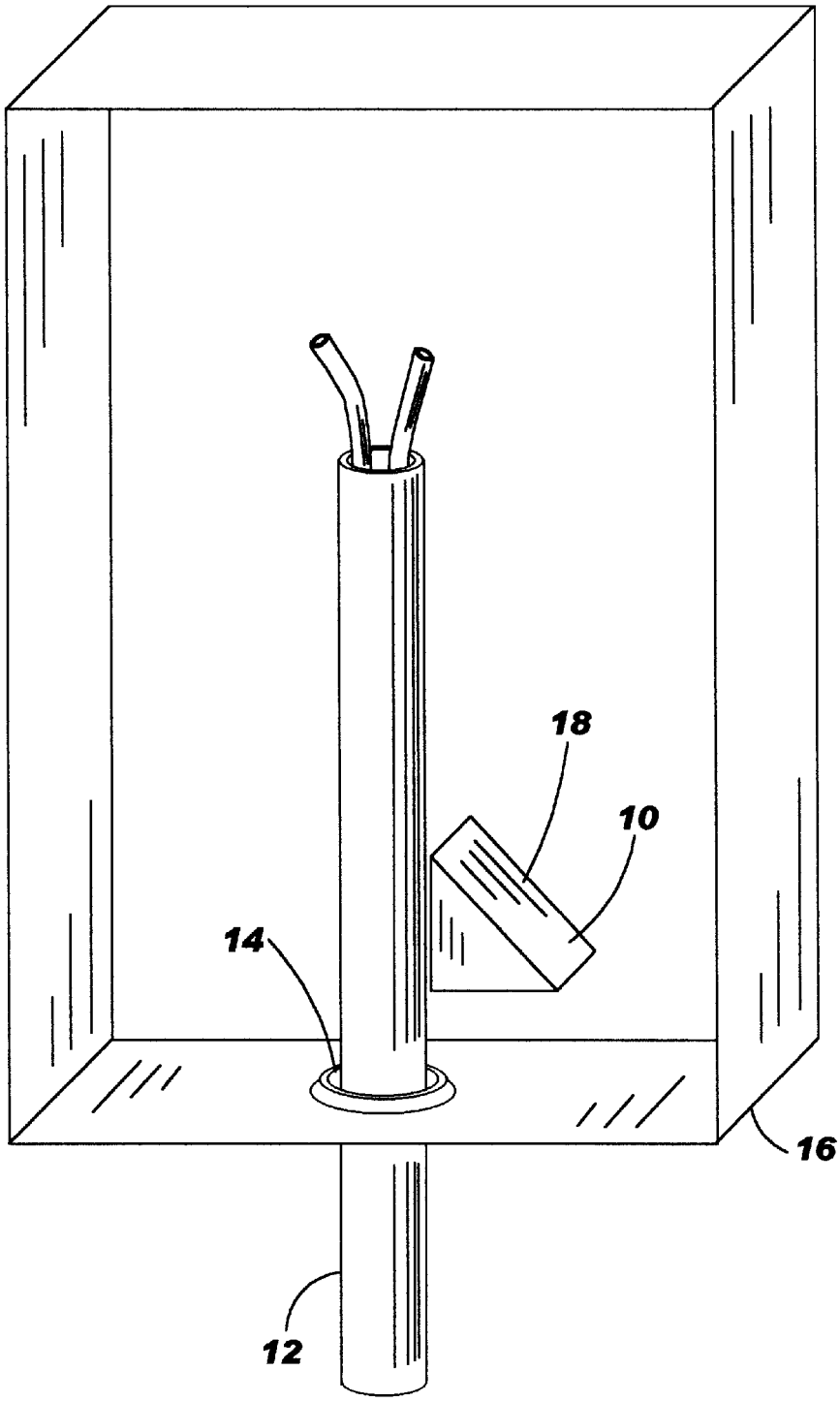
FIG. 1 is a schematic illustrating an operating environment for this invention.

FIG. 1 is a schematic illustrating an operating environment for this invention. This invention is an apparatus 10 that secures to an electrical conducting cable 12. The cable 12 routes through an aperture 14 in a terminal box or enclosure 16. The apparatus 10 acts as a barrier 18 and hinders, or even prevents, the cable 12 from pulling through the aperture 14. Although the barrier 18 secures to the cable 12, the cable 12, however, can push through the aperture 14. The apparatus 10 of this invention, then, hinders or prevent the cable 12 from pulling out of the enclosure 16, yet this invention permits the cable 12 to be pushed into the enclosure 16.

Figure 2:
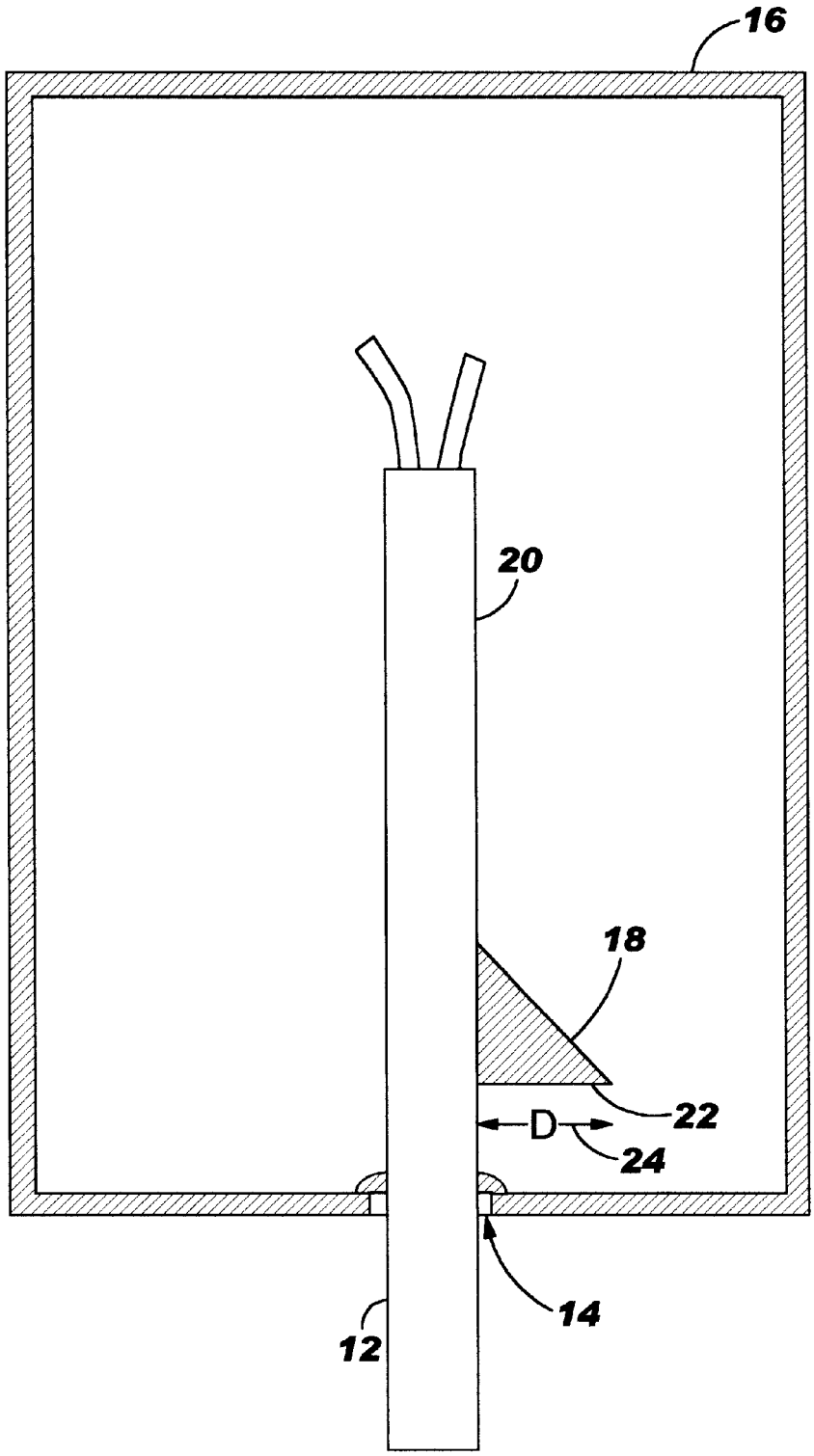
FIG. 2 is a schematic further illustrating the operation of this invention.

FIG. 2 is a schematic further illustrating the operation of this invention. FIG. 2 is a sectional view of the componentry shown in FIG. 1. The cable 12 routes through the aperture 14 in the enclosure 16. The barrier 18 secures to a portion 20 of the cable 12 routed within the enclosure 16. As FIG. 2 shows, the barrier 18 has a base 22. The base 22 has a diameter "D" (shown as reference numeral 24) greater than the diameter of the aperture 14 through which the cable 12 passes. Because the diameter 24 of the base 22 is greater than the aperture 14, the barrier 18 hinders the cable 12 from pulling through the aperture 14. Because the barrier 18 preferably secures to the portion 20 of the cable 12 routed within the enclosure 16, the barrier 18 allows the cable 12 to push through the aperture 14 and into the enclosure 16. The barrier 18 thus helps prevent the cable 12 from pulling out of the enclosure 16, yet, the barrier 18 permits slack in the cable 12 when pulled from within the enclosure 16.

Figure 3:
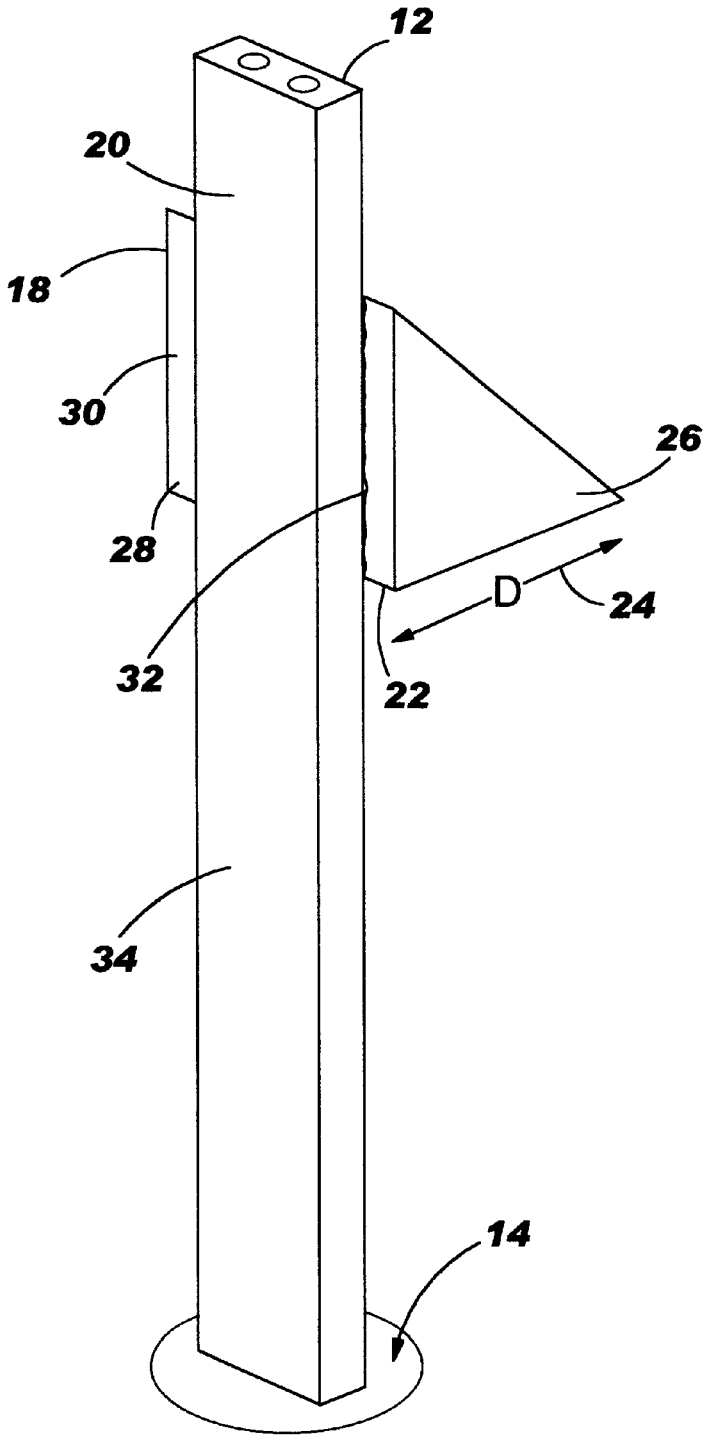
FIG. 3 is a schematic showings further details of the barrier shown in FIGS. 1 and 2.

FIG. 3 is a schematic showings further details of the barrier 18 shown in FIGS. 1 and 2. The barrier 18 generally has a polyhedral shape and is preferably formed of molded material. FIG. 1 shows the barrier 18 having a pentahedral shape resembling a wedge 26. The barrier 18 has a side surface 28 that secures to the cable 12. As FIG. 3 shows, the side surface 28 includes a planar portion 30 that abuts the cable 12. The side surface 28 is preferably adhered to the cable 12. An adhesive 32 is applied between the side 30 and the cable 12 to secure the barrier 18. The planar portion 30 of the side surface 28 maximizes an adhesive region contacting specially-shaped conductors, such as a rectangularly-shaped aerial service wire 34. Because the diameter "D" (shown as reference numeral 24) of the base 22 is greater than the diameter of the aperture 14, the barrier 18 helps prevent the aerial service wire 34 from pulling through the aperture 14. Because the barrier 18 preferably secures to the portion 20 of the aerial service wire 36 routed within the enclosure (shown as reference numeral 16 in FIGS. 1 and 2), the barrier 18 allows the aerial service wire 34 to push through the aperture 14 and into the enclosure. The barrier 18 thus helps prevent the aerial service wire 34 from pulling out of the enclosure, yet the barrier 18 permits slack in the aerial service wire 34 when pulled from within the enclosure.

The barrier 18 may have any shape. Although the barrier 18 is shown having a pentahedral shape, the barrier 18 may have any shape. The barrier 18 could be squarely-shaped, rectangularly-shaped, spherically-shaped, or any other shape that helps prevent the cable 12 from pulling out of the enclosure. Whatever the shape of the barrier 18, the barrier 18 has some portion having a diameter greater than the diameter of the aperture 14.

Figure 4:
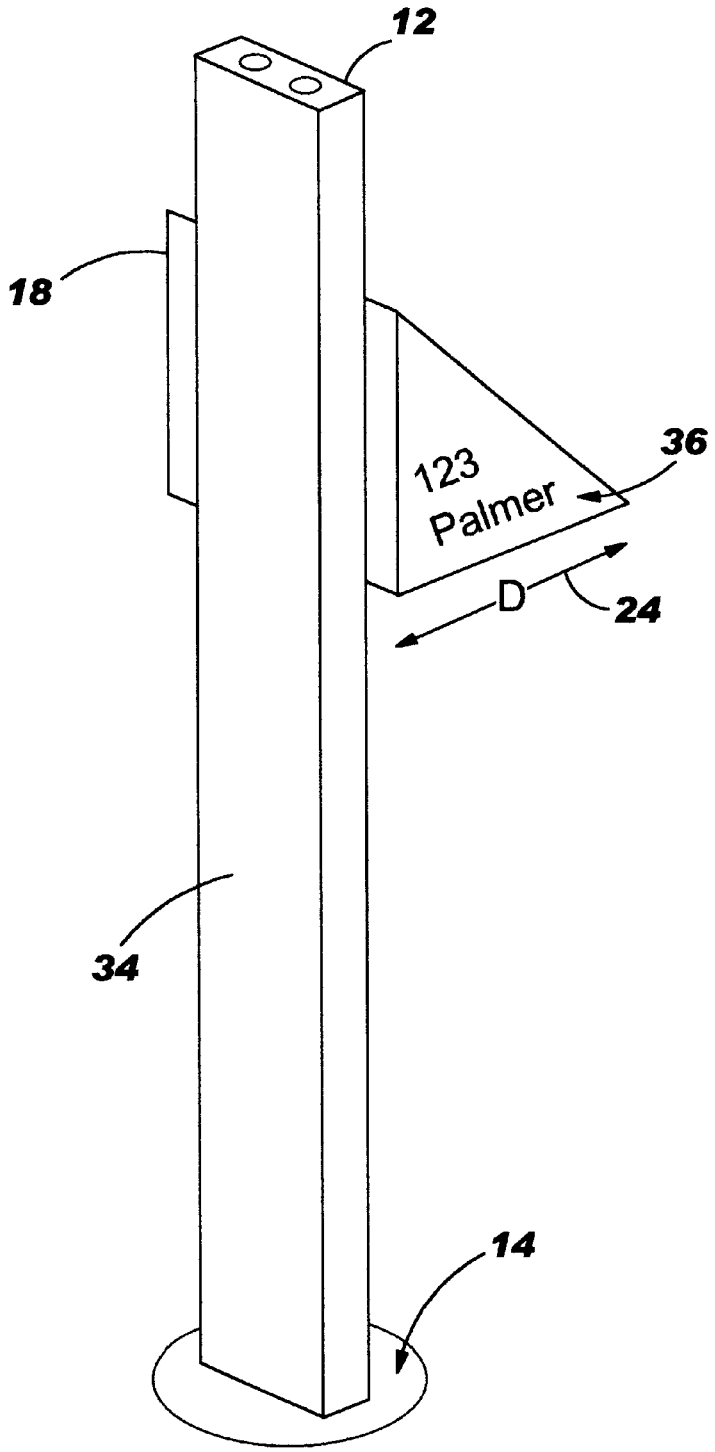
FIG. 4 is a schematic showing an alternative embodiment of this invention.

FIG. 4 is a schematic showing an alternative embodiment of this invention. Here the barrier 18 includes destination indicia 36. The destination indicia 36 indicate a telecommunications customer being served by the cable 12 (or by the aerial service wire 34). The destination indicia 36 is associated with information content related to the utility/telecommunications customer (e.g., a customer's address, account number, telephone number, telecommunications service provider, utility service provider, etc.). The destination indicia 36 could also be associated with trackability information (e.g., name of component manufacturer, component model number, repair history, etc.). As FIG. 4 shows, the destination indicia 36 may be alphanumeric characters, symbols, combinations thereof, and bar codes (e.g., "123 Palmer" Street). When the barrier 18 is marked with the destination indicia 36, contrasting colors may be used to better distinguish the destination indicia 36 (e.g., black alphanumeric characters and/or symbols on a white surface). Further, the destination indicia 36 may be marked, printed, etched, affixed, attached, stamped, or adhered to the barrier 18. Alternatively, other methods of marking the destination indicia 36 may be used, such as, for example, applying a film, substrate, magnetic material, or the like to the barrier 18.

Figure 5:
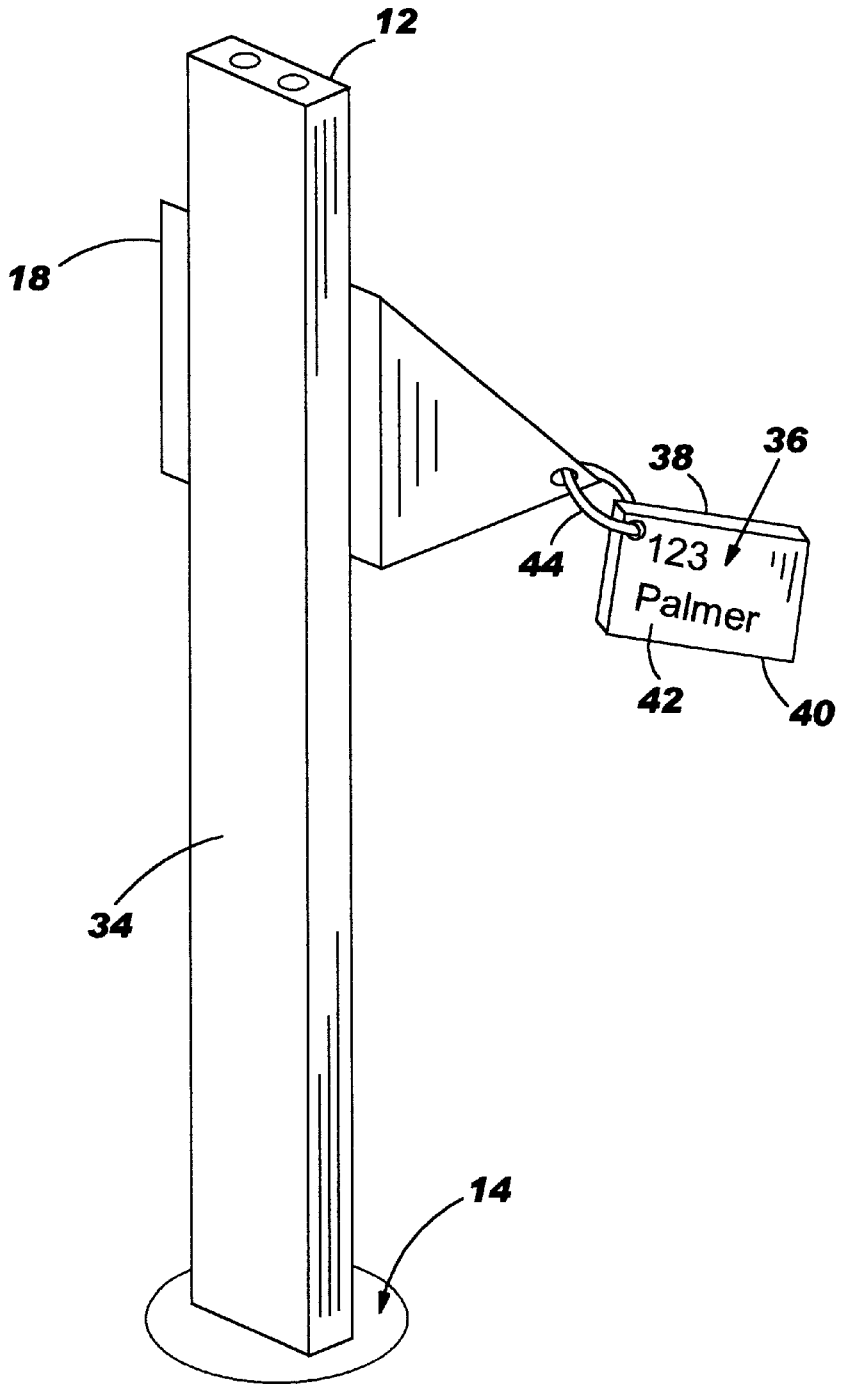
FIG. 5 is a schematic showing yet another alternative embodiment of this invention.

FIG. 5 is a schematic showing yet another alternative embodiment of this invention. Here the barrier 18 includes a destination wire tag 38. The destination wire tag 38 has a tag body 40 and means for securing the destination wire tag 38 to the cable 12 (or to the aerial service wire 34 shown in FIG. 3). The destination wire tag 38 has a surface 42 marked with the destination indicia 36. The destination indicia 36 comprise a preconceived pattern associated with information content of the cable 12 (or the aerial service wire 34). The destination wire tag 38 may be manufactured from a variety of materials, such as, for example, paper, cloth, metal, polymer, plastic, ceramic, glass, crystal, and other appropriate materials. Further, the destination wire tag 38 may be designed using a variety of shapes to suit the application. The destination wire tag 38 may include a separable, transparent sub-surface area located on the surface 42, the sub-surface area engaging the destination indicia 36 to locate the destination indicia 36 on the surface 42. Further, the destination wire tag 38 may be manufactured using any appropriate material that can withstand exposure to temperatures, humidity, ozone, and other environmental conditions.

The destination wire tag 38 secures to the cable 12. The destination wire tag 38 is preferably secured to the cable 12 using one or more ties 44. These ties 44 resemble common metal "bread ties" or plastic ties. The destination wire tag 38 could also secure to the cable 12 using adhesives, magnets, clips, screws, clamps, hooks, and any other mechanical and/or chemical securement.

The barrier 18 itself could include color-coding. This color-coding would be used to indicate a telecommunications customer being served by the cable 12. The color-coding would be associated with information content related to the utility/telecommunications customer (e.g., the customer's address, account number, telephone number, telecommunications service provider, utility service provider, etc.). The color-coding could also be associated with trackability information (e.g., the name of a component manufacturer, component model number, repair history, etc.). The color-coding could be a single color and/or contrasting colors. The color-coding could also include bar coding.

Figure 6:
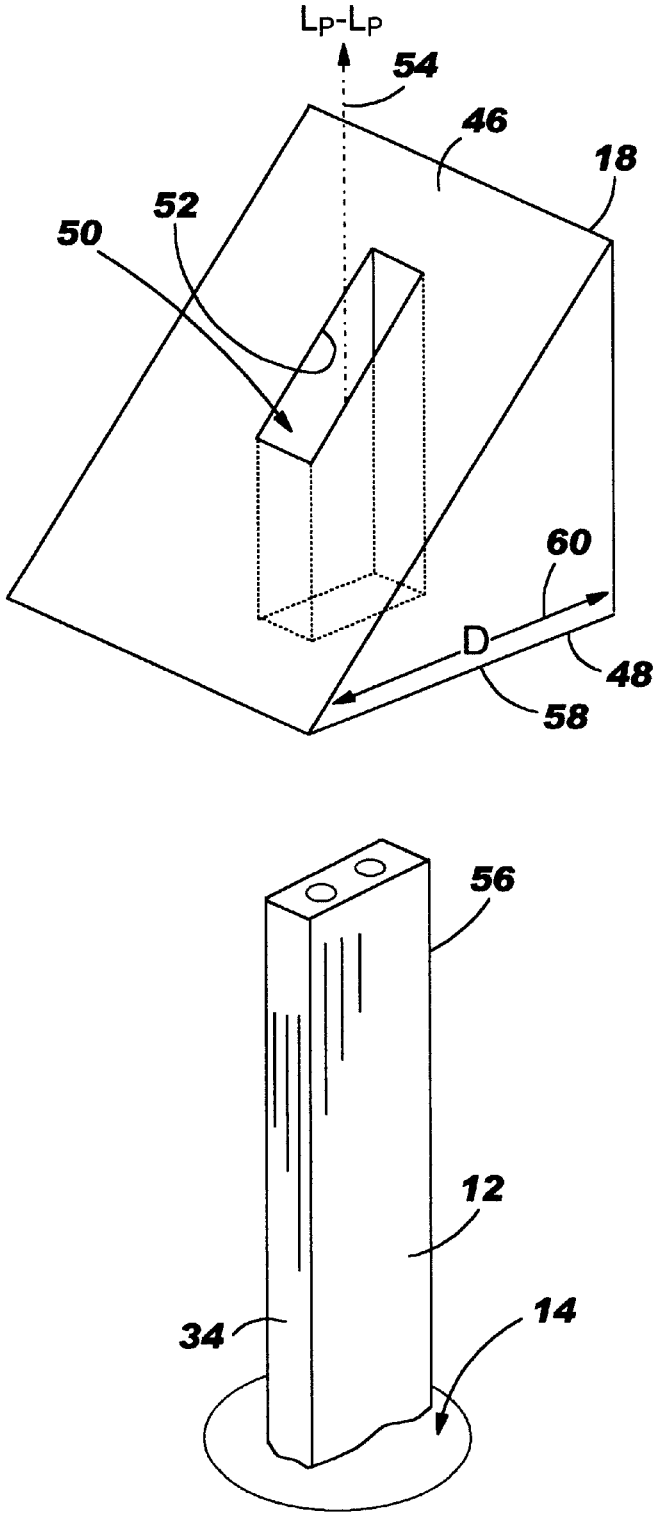
FIG. 6 is a schematic showing still another alternative embodiment of this invention.

FIG. 6 is a schematic showing still another alternative embodiment of this invention. Here the barrier 18 clamps to the cable 12. The barrier 18 has an upper end 46, a lower end 48, and an interior passage 50. The interior passage 50 extends from the upper end 46 to the lower end 48. The interior passage 50 has an inner wall 52 defining a passage axis $L_P$-$L_P$ (shown as reference numeral 54). The passage axis $L_P$-$L_P$ extends from the upper end 46 to the lower end 48. The interior passage 50 is open at the upper end 46 and open at the lower end 48. An end 56 of the cable 12 inserts into the lower end 48, pushes through the interior passage 50, and pushes out the upper end 46. A diameter of the interior passage 50 is sized to frictionally clamp the cable 12 within the interior passage 50.

The barrier 18 also has a base 58. The base 58 has a diameter "D" (shown as reference numeral 60) greater than the aperture 14 through which the cable 12 passes. The base 58 of the barrier 18, as earlier explained, hinders the cable 12 from pulling through the aperture 14, yet the barrier 18 allows the cable 12 to push through the aperture 14. Because the barrier 18 preferably secures to a portion of the cable 12 routed within the enclosure (shown as reference numeral 16 in FIGS. 1 and 2), the barrier 18 allows the cable 12 to push through the aperture 14 and into the enclosure. The barrier 18 thus helps prevent the cable 12 from pulling out of the enclosure, yet the barrier 18 permits slack in the cable 12 when pulled from within the enclosure.

Figure 7:
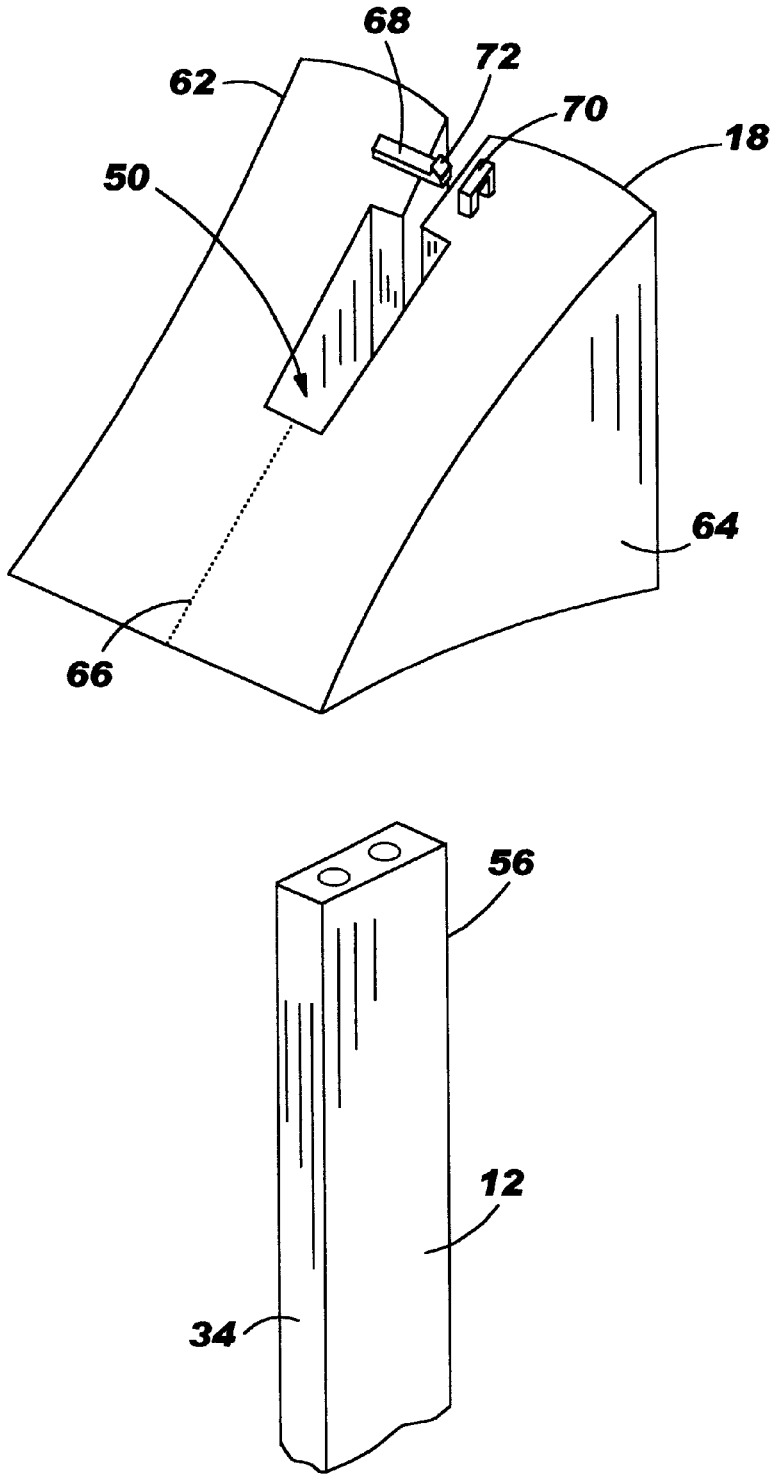
FIG. 7 is a schematic showing another alternative embodiment of this invention.

FIG. 7 is a schematic showing another alternative embodiment of this invention. Here the barrier 18 comprises a left halve 62 and a right halve 64. The left and right halves 62, 64 fold about a hinge 66 to clamp the cable 12 in the interior passage 50. FIG. 7 shows the barrier 18 in a deformed view to emphasize the preferably pliable construction of the left and right halves 62, 64. The end 56 of the cable 12 inserts into the lower end of the interior passage 50, pushes through the interior passage 50, and pushes out the upper end of the interior passage 50. The diameter of the interior passage 50 is sized to frictionally clamp the cable 12 within the interior passage 50. This embodiment also comprises means for fastening the left halve 62 to the right halve 64. A tab 68, for example, engages a receiver 70. The tab 68 includes a hooked portion 72 to engage the receiver 70 and to fasten the left halve 62 to the right halve 64. The hooked portion 72 is preferably sized to permit the blade of a screwdriver (not shown) to disengage the hooked portion 72 from the receiver 70, thus unclamping the cable 12 from within the interior passage 50. The left and right halves 62, 64 could also be fastened using adhesives, magnets, clips, clasps, screws, clamps, hooks, and any other mechanical and/or chemical securement. The means for fastening the left halve 62 to the right halve 64 may be constructed on any side or any portion of the barrier 18.

Figure 8:
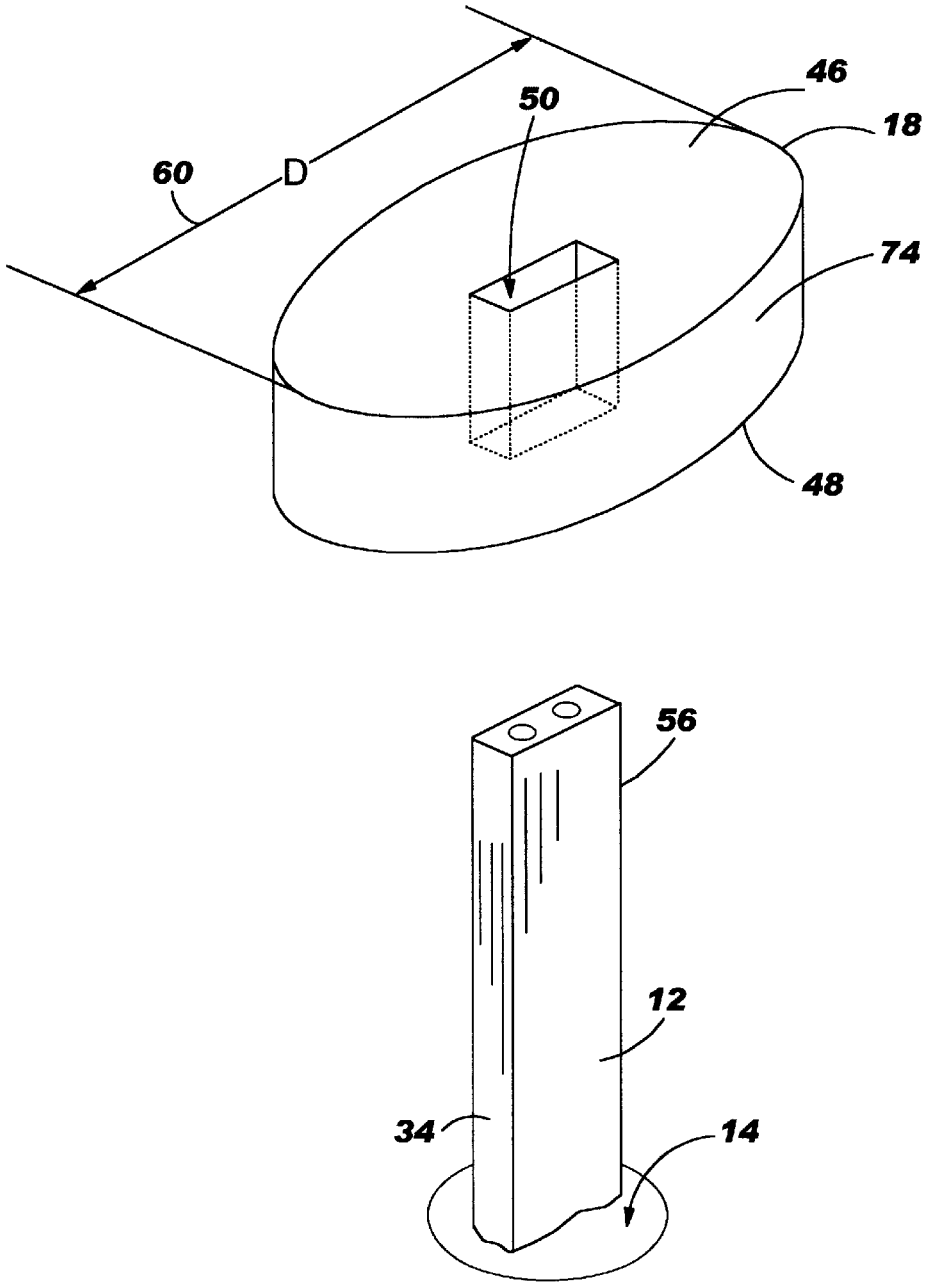
FIGS. 8–13 are schematics showing yet other alternative embodiments of this invention.
Figure 9:
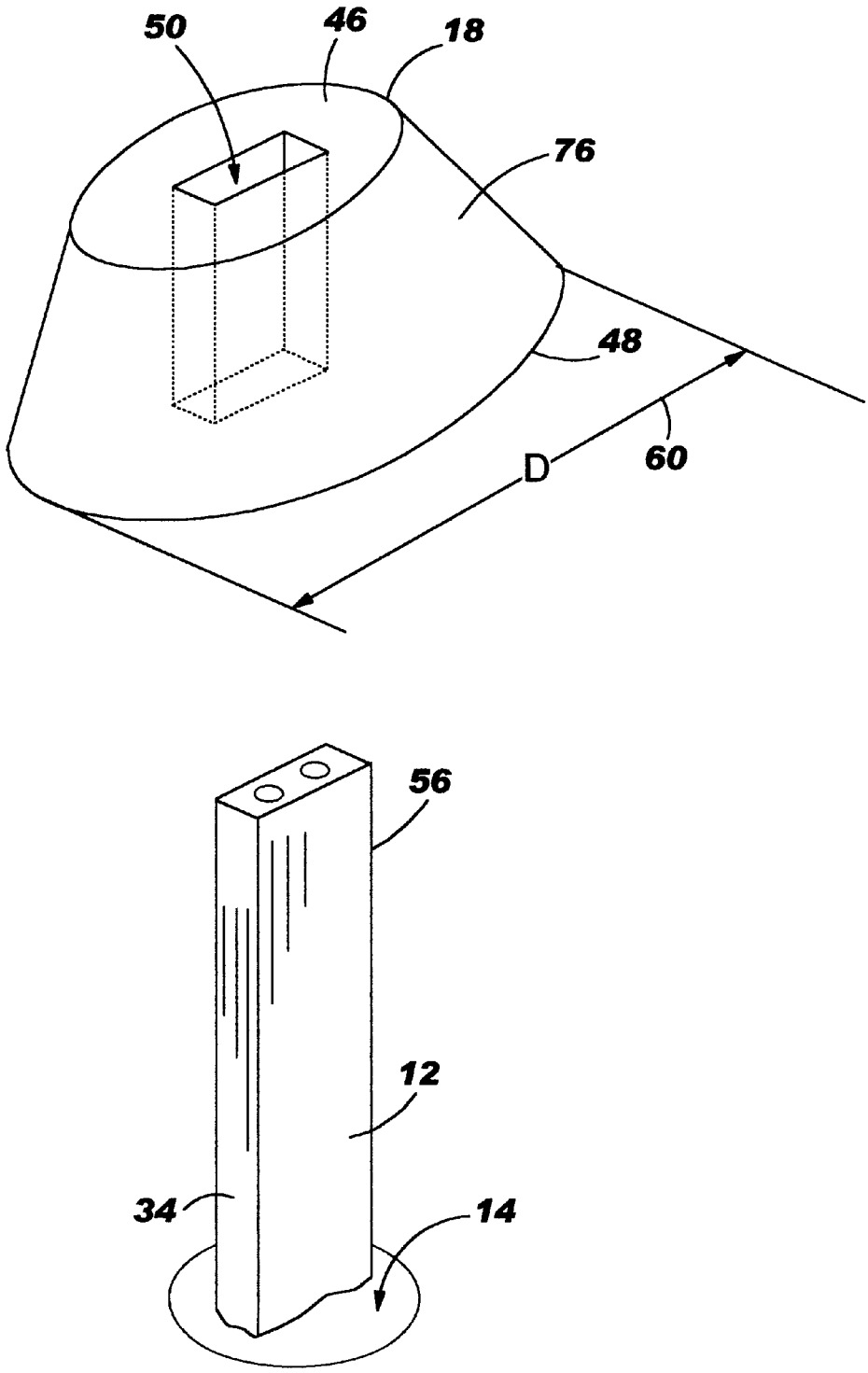
Figure 10:
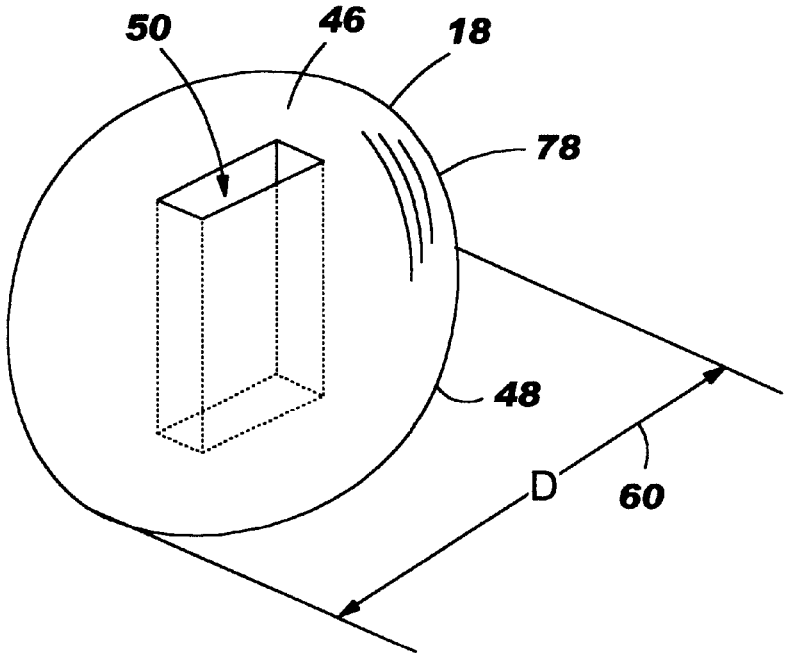
Figure 10:
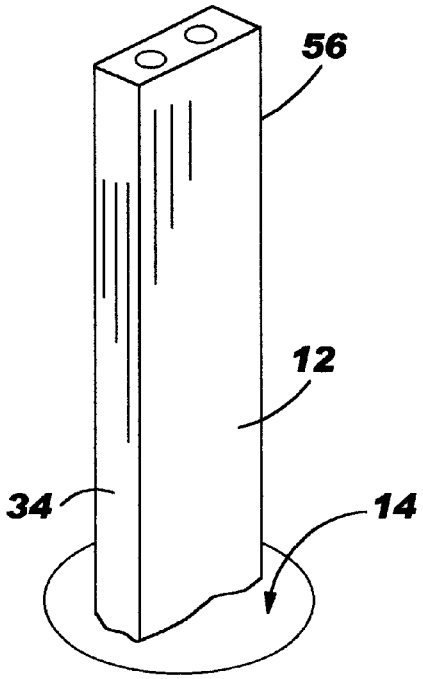
Figure 11:
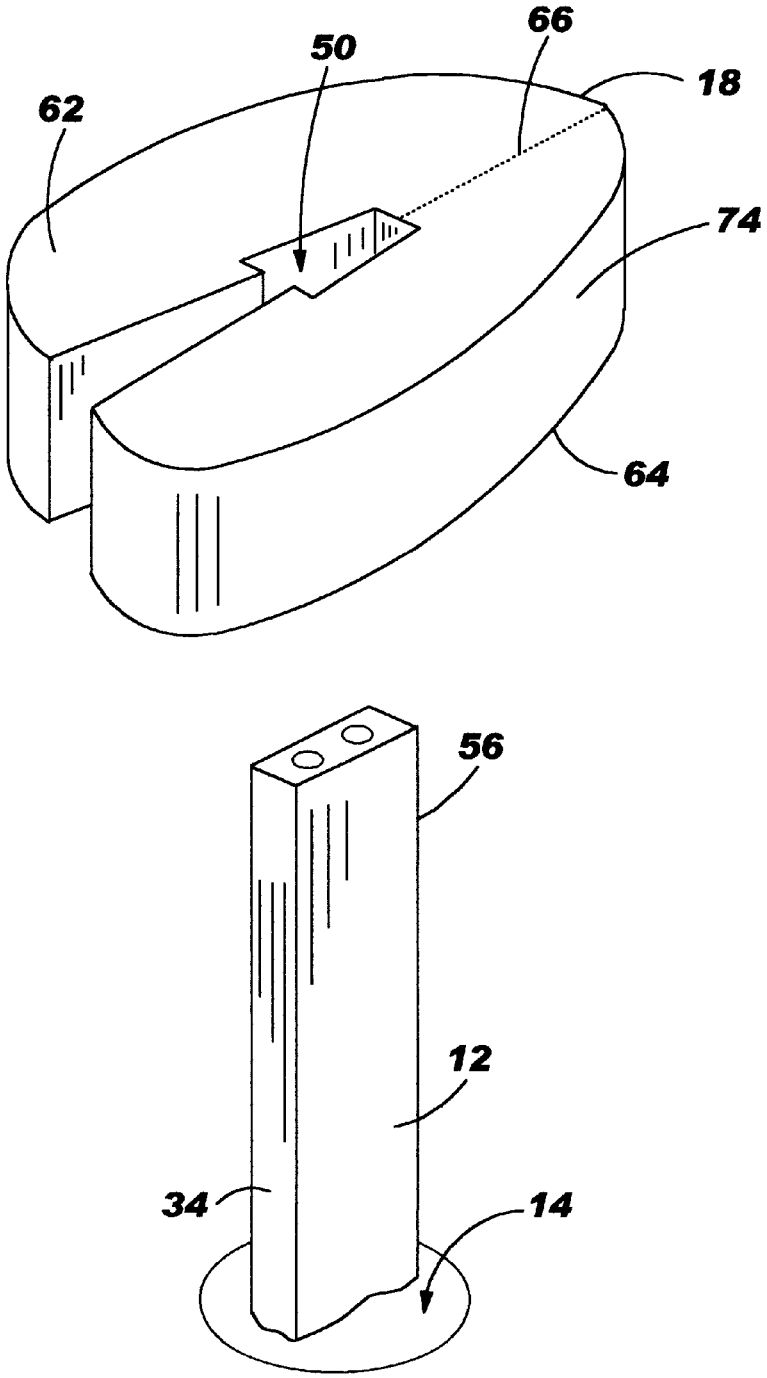
Figure 12:
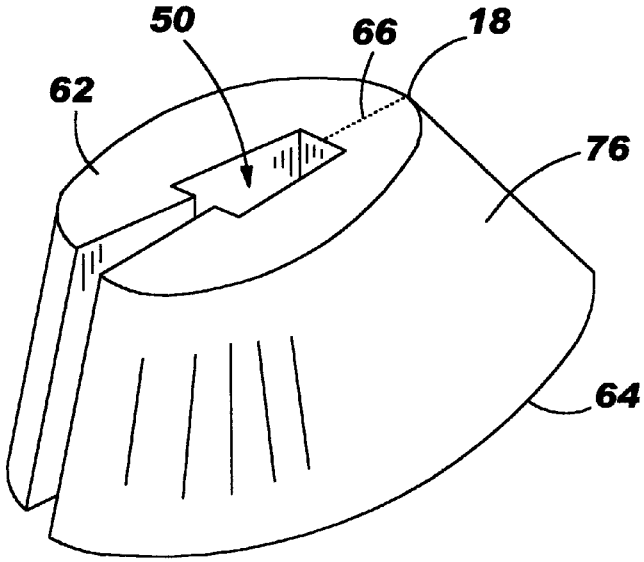
Figure 12:
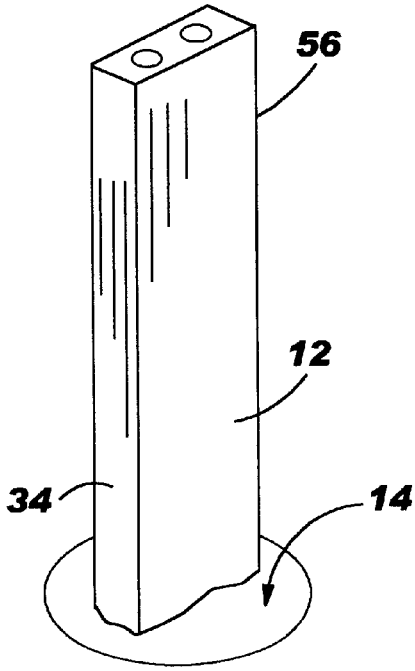
Figure 13:
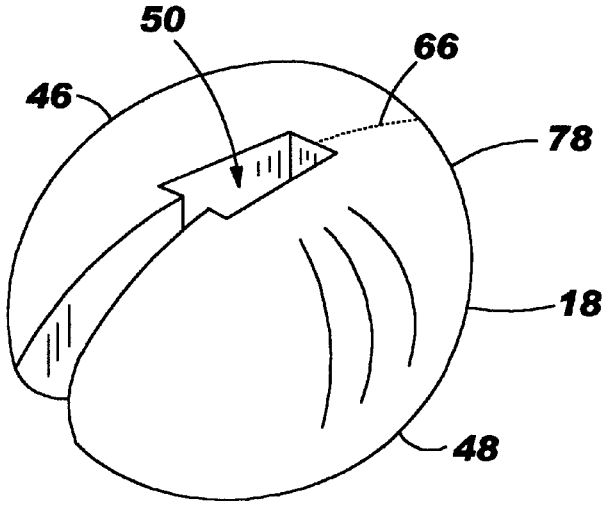
Figure 13:
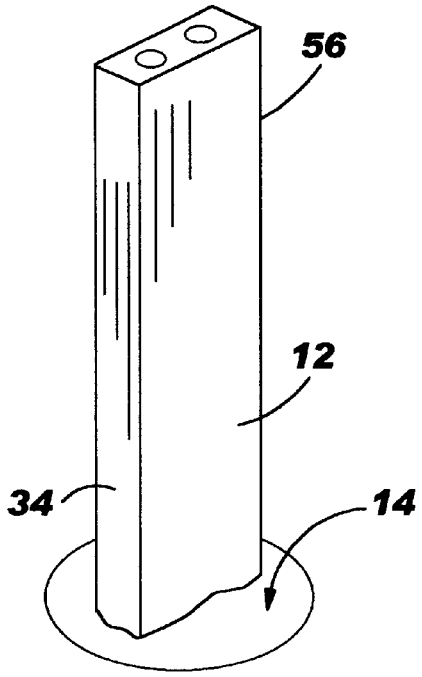

FIGS. 8–13 are schematics showing yet other alternative embodiments of this invention. While FIGS. 1 through 7 show the barrier 18 having a pentahedral shape (e.g., the wedge-shape 26 discussed with reference to FIG. 3), FIGS. 8–10 illustrate the barrier 18 may have any shape that helps prevent the cable 12 from pulling out of the enclosure (shown as reference numeral 16 in FIGS. 1 and 2). FIG. 8 shows the barrier 18 having a generally cylindrical outer side wall 74, FIG. 9 shows the barrier having a frustoconical outer surface 76, and FIG. 10 shows the barrier 18 having a spherical outer surface 78. The barrier 18 has the interior passage 50 extending from the upper end 46 to the lower end 48. The cable 12 is frictionally clamped within the interior passage 50. Whatever the shape of the barrier 18, the barrier 18 has some portion having a diameter "D" (shown as reference numeral 60) greater than the aperture 14 through which the cable 12 passes. FIGS. 11–13 illustrate the barrier 18 may include the left and right halves 62, 64. FIG. 11 shows the barrier 18 having the generally cylindrical outer side wall 74, FIG. 12 shows the barrier having the frustoconical outer surface 76, and FIG. 13 shows the barrier 18 having the spherical outer surface 78. FIGS. 11–13 also show the barrier 18 in a deformed view to emphasize the preferably pliable construction of the left and right halves 62, 64. Whatever the shape of the barrier 18, the left and right halves 62, 64 fold about the hinge 66 to clamp the cable 12 in the interior passage 50. Because the barrier 18 preferably secures to a portion of the cable 12 routed within the enclosure (shown as reference numeral 16 in FIGS. 1 and 2), the barrier 18 allows the cable 12 to push through the aperture 14 and into the enclosure. The barrier 18, however, helps prevent the cable 12 from pulling out of the enclosure 18.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus for securing cable, comprising:

a barrier adhesively adhered to the cable, the barrier having a base, the base having a diameter greater than an aperture through which the cable passes, the base of the barrier hindering the cable from pulling through the aperture, yet the barrier allowing the cable to push through the aperture.

2. An apparatus according to claim 1, wherein the barrier is formed of molded material.

3. An apparatus according to claim 1, wherein the barrier has a polyhedral shape.

4. An apparatus according to claim 1, wherein the barrier has a pentahedral shape.

5. An apparatus according to claim 4, wherein the pentahedral shape of the barrier resembles a wedge.

6. An apparatus according to claim 4, wherein one side of the pentahedrally-shaped barrier is adhered to the cable.

7. An apparatus according to claim 1, the barrier further comprising a side surface, the side surface adhered to the cable.

8. An apparatus according to claim 1, wherein the barrier includes destination indicia, the destination indicia indicating a telecommunications customer being served by the cable.

9. An apparatus according to claim 1, wherein the barrier comprises a color-coding to indicate a telecommunications customer being served by the cable.

10. An apparatus for securing cable, comprising:

a barrier clamped to the cable, the barrier having an upper end, a lower end, and an interior passage extending from the upper end to the lower end, the interior passage having an inner wall defining a passage axis extending from the upper end to the lower end, the interior passage open at the upper end and open at the lower end such that an end of the cable is inserted into the lower end, pushed through the interior passage, and pushed out the upper end;

the barrier also having a base, the base having a diameter greater than an aperture through which the cable passes, the base of the barrier hindering the cable from pulling through the aperture, yet the barrier allowing the cable to push through the aperture.

11. An apparatus according to claim 10, the barrier further comprising a left halve and a right halve, the left and right halves folding to clamp the cable in the interior passage.

12. An apparatus according to claim 10, further comprising means for fastening the left halve to the right halve.

* * * * *